United States Patent [19]

Schaffeler

[11] Patent Number: 4,618,747

[45] Date of Patent: Oct. 21, 1986

[54] ELECTRICAL SNAP SWITCH WITH DOUBLE ARM RESETTING LEVER

[75] Inventor: Alois Schaffeler, Spaichingen, Fed. Rep. of Germany

[73] Assignee: Marquardt GmbH, Fed. Rep. of Germany

[21] Appl. No.: 657,341

[22] Filed: Oct. 3, 1984

[30] Foreign Application Priority Data

Oct. 6, 1983 [DE] Fed. Rep. of Germany ..... 3336338

[51] Int. Cl.[4] ..... H01H 5/06; H01H 15/18

[52] U.S. Cl. ..... 200/67 PK; 200/DIG. 42; 200/157; 200/76

[58] Field of Search ..... 200/76–78, 200/67 A, 67 B, 67 PK, 157, DIG. 42, 68.1, 16 R, 16 A, 243

[56] References Cited

U.S. PATENT DOCUMENTS

| | | | |
|---|---|---|---|
| 3,967,081 | 6/1976 | Portmann et al. | 200/67 PK |
| 4,347,415 | 8/1982 | Falchi | 200/67 R X |
| 4,427,856 | 1/1984 | Atsumi et al. | 200/76 |
| 4,472,328 | 4/1984 | Schaffeler | 200/76 |
| 4,472,612 | 9/1984 | Hinterberger | 200/67 PK |

FOREIGN PATENT DOCUMENTS

| | | | |
|---|---|---|---|
| 1935225 | 12/1971 | Fed. Rep. of Germany | 200/67 PK |
| 2716483 | 10/1978 | Fed. Rep. of Germany | 200/76 |
| 3126816 | 1/1983 | Fed. Rep. of Germany | 200/76 |

*Primary Examiner*—Stephen Marcus
*Assistant Examiner*—Ernest G. Cusick
*Attorney, Agent, or Firm*—McGlew & Tuttle

[57] ABSTRACT

To be able to disengage the contacts of a switch in the event of a breakage of the snap spring or if the contacts become melted together, a pivotable resetting member in the form of a two-armed lever is provided. One arm of the lever is associated with the inside end of an operating plunger, while its other arm is associated with the end of a slide of the switch. While being displaced from its initial position into the switched position, the slide pushes the resetting member and the end of the operating plunger moved thereby away from the respective arm of the resetting member. By pushing the operating plunger against the actuator, the end of the plunger acts against the arm of the resetting member whose pivotal motion then causes the slide to be pushed into its initial position.

3 Claims, 1 Drawing Figure

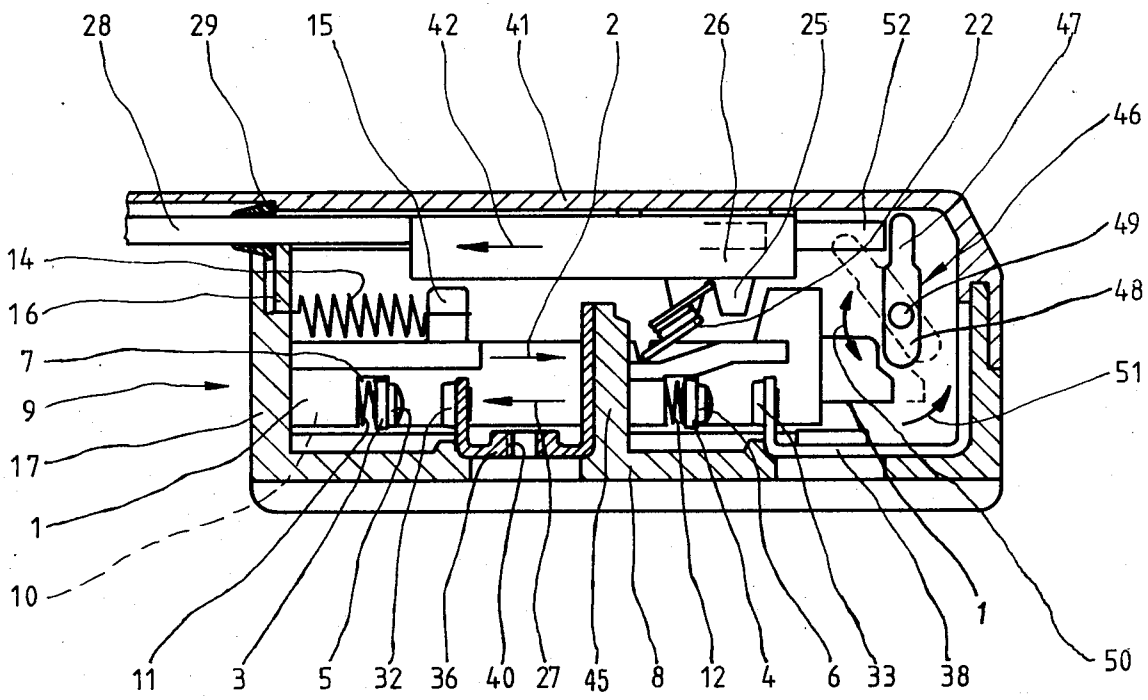
47
22
52
25
26
2
41
42
15
29
28
46
49
48
51
50
1
38
33
6
4
12
8
45
27
40
36
32
5
3
11
14
16
7
9
17
1
10

ELECTRICAL SNAP SWITCH WITH DOUBLE ARM RESETTING LEVER

FIELD AND BACKGROUND OF THE INVENTION

This invention relates in general to an electrical switch construction and in particular to a new and useful electrical switch which has a movable plunger which operates a movable slide containing movable contacts which engage respective fixed contacts and including a resetting member which is actuated by the movement of the plunger to cause a corresponding movement of the slide in an opposite direction.

A switch similar to the inventive switch is disclosed, for example, in German OS No. 31 25 816 (U.S. Pat. No. 4,442,328). A preferred embodiment of this prior art switch is an electrical switch having a bracket-shaped snap spring, with the plane of the spring extending obliquely to the plane of displacement of the slide and the operating plunger, and in the two end positions, being operatively inclined relative to a neutral position. A displacement of the operating plunger causes the spring to tilt in the direction of the neutral position. Such switches are employed particularly for closing or opening DC circuits. They are not limited to such use however. A relatively strong snap spring may be provided to obtain a strong resetting force. Also, a return spring may be provided acting on the slide, only such a spring must be substantially weaker since it is tensioned during the switching operation.

It happens from time to time, that the contacts melt together so that a particularly strong resetting force is needed which cannot be produced by the springs. Another possible trouble is that if a spring breaks, and, particularly, with the movable contacts sticking to the fixed ones at the same time, opening of the contacts becomes impossible.

SUMMARY OF THE INVENTION

The invention is directed to a switch which is improved to the effect that even under difficult and particularly adverse conditions, closed contacts can be disengaged from each other securely.

In accordance with the invention the electrical switch comprises a housing in which two fixed contacts are arranged in spaced relationship and in which a slide is movably mounted and carries movable contacts therewith which may be moved with the slide into engagement with the fixed contacts. The slide is returned to a non-contact position by a tension spring and it is actuated into a contact making position by a movable plunger which acts through a snap spring to snap the slide into a contact making position. A feature of the construction is the provision of a resetting two-armed lever member which is pivotably mounted in the housing adjacent the respective ends of the slide and plunger which are arranged for parallel displacement. The resetting member includes a one arm portion which is displaced by the plunger in one direction and an opposite arm portion which is displaced in an opposite direction so that movement of the plunger cause a corresponding movement of the slide in a respective opposite direction.

The longitudinal axis of the resetting member, which is designed as a two-armed lever, extends transversely, particularly perpendicularly, to the longitudinal axes or directions of displacement of the operating plunger and the slide. The pivotal axis of the resetting member thus extends perpendicularly to the longitudinal axis thereof and, at the same time, perpendicularly to the direction of displacement. Yet, this axis extends in a switching zone between the operating plunger and the slide. Since the operating plunger as well as the slide are coupled by their ends to the resetting member and move in opposite directions, the resetting member is rotated, for example, counterclockwise, as soon as the switch is actuated and clockwise as soon as the parts are returned into their initial positions. If the returning part is the operating plunger, this return motion is transformed through the two-armed lever into an opposite resetting motion of the lever arm facing the end of the slide. The slide is thereby shifted back into its initial position. The return, however, may also be effected by the usually provided spring or springs. To avoid an interference in such instances, it is advisable to make the operating plunger and the slide only engageable by to the resetting member and not coupled thereto firmly. On the other hand, an at least unilateral firm coupling with a proper design of a sliding pivotal connection should not be excluded.

In a preferred embodiment of the invention, it is provided that in the rest position of the switch, the first lever arm of the resetting member extends directly in front of or engages against to the inside end of the operating plunger and the second lever arm extends directly in front of engages against the identically directed end of the slide. By "directly in front of" it is understood that a certain play may be provided between the respective end of the operating plunger or the slide and the associated lever arm of the setting member, which play allows manufacturing tolerances and facilitates the assembly. With short displacements, however, a play may be omitted and, particularly between the slide and the resetting member, a direct contact in the initial position of the switch may be provided.

Upon actuating the switch, the slide is moved by the operating plunger and the snap spring oppositely to the operating plunger and its leading end during this motion causes pivoting of the resetting member. The lever arm associated with the operating plunger is in front of this leading or inside end thereof without necessarily engaging it against. More particularly, it is provided that during the end phase of the stroke of the operating plunger, the inside end thereof moves away from the associated lever arm of the resetting member, so that a certain dead clearance forms for the resetting. This means that as the switch parts are reset, the inside end of the operating plunger hits the associated lever arm of the resetting member only after moving through the dead clearance. Then, the lever arm is pivoted back into its initial position in which the two lever arms are associated with their switching parts or engaged against them. However, should it be necessary to disengage the contacts from each other or reset the slide or the operating plunger, the associated lever arm of course engages against the slide during the resetting thereof, since this is the purpose of its motion. With a snap-action return of the slide caused by the snap spring, the slide may become disengaged from the lever arm for a brief interval of time.

In a particularly preferred embodiment of the invention, it is provided that the operating plunger and the slide are displaced through unequal distances and the lever arms of the resetting member also have unequal lengths, with the longer one of the lever arms being associated with the part to be displaced through the longer distance, particularly with the operating plunger. Then, of course, the shorter lever arm is associated with the switch part with the shorter displacement, particularly the slide. This provides a certain mechanical advantage augmenting the force by which the slide is reset. Otherwise, the resetting member is an extremely simple part which may be made of plastic and can easily be mounted in corresponding, particularly open, bearing elements. Negligible costs thus lead to a great advantage or augmented safety in the use of the switch.

Accordingly, it is an object of the invention to provide an improved switch construction on which the two movable contact elements carried by a movable slide are engageable with two fixed contacts in a housing and normally returned to a non-making position by a tension spring into an arrangement of a resetting member which is operable by displacement of a plunger which acts through a snap spring to move the slide and in so doing pivot a setting member in the form of a double arm lever which has one arm portion engageable with the plunger and another with the slide so as to move the slide in respective opposite direction to the plunger.

A further object of the invention is to provide a switch which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

In the drawing:

The only FIGURE of the drawings is a longitudinal sectional view of a switch constructed in accordance with the invention shown in initial position.

DESCRIPTION OF THE PREFERRED EMBODIMENT

Referring to the drawing in particular the invention embodied therein comprises an electrical switch having a housing 9 with first and second fixed contacts 32 and 33 arranged in spaced relationship in the housing. A slide 1 is movably mounted in the housing 9 as first and second movable contacts 5 and 6 which are movable therewith into contact making positions in which they engage the respective fixed contacts 32 and 33. The slide 1 is also movable out of a contact making position to the neutral position shown in the drawings by spring means in the form of a tension spring 14 which urges the slide 1 out of the contact making position. An actuating plunger 26 is movably mounted in the housing 9 backwardly and forwardly substantially parallel to the slide 1. A snap spring 22 engaged between the plunger 26 and the slide 1 is effective upon movement of the plunger to move the slide rapidly into a contact making position.

In accordance with the invention a two armed resetting member or lever 46 is pivotally mounted in the housing between the plunger 26 and the slide 1 and alongside their respective ends and it has respective arm portions which are engageable with the plunger and the slide end so that movement of the plunger in one direction causes a corresponding movement of the slide in an opposite direction.

The shown switch is designed as a double switch comprising contact bridges 3 and 4 provided on a slide 1 in a tandem arrangement in the direction of displacement 2, and having each a pair of contacts 5, 6. For this purpose, slide 1 is provided for each bridge with a receiving slot 7 and a pocket 10 which is open to the bottom 8 of the switch housing 9 and in which a helical compression spring 11, 12 is provided by which the contact bridge 3 and 4 is pressed against the right hand edge of the receiving slot. A small central boss of contact bridge 3 and 4 on the side remote from the movable contacts 5 and 6 serves the purpose of centering the helical compression springs 11 and 12. A helical tension spring 14 having its leading end in the direction of displacement 2 attached to an extension 15 of slide 1 and its trailing end in this direction attached to a holding element 16 of switch housing 9, pulls the slide 1 to the rear wall 17 of the switch, against the direction 2.

About at the leading end in the direction 2 of slide 1, two groove-like recesses are provided in the slide in which respective free ends of the legs of an approximately C-shaped bracket spring 22 are engaged. The two recesses are offset relative to each other in the direction 2 by about the wire thickness, and the free ends of the legs of the non-loaded bracket spring 22 are spaced from each other about by the same lateral distance. This makes it possible for these ends to pass by each other in loaded state. The back of the springs 22 engages between prongs of a forked drive 25 about at the inside end of an operating plunger 26.

In the initial position of the switch (solid lines) a plane passing through the bracket spring 22 extends obliquely to the rear wall 17 of the switch, for example. Consequently, the operating plunger 26 is spring loaded in the direction 2, and the slide 1 is spring loaded in an opposite direction 27. Operating plunger 26 comprises a cylindrical shank 28 which extends through a sealing sleeve 29 to the outside. Lateral portions of the bracket spring 22 are formed each by three turns, for example.

The housing of the switch supports fixed pairs of contacts 32 and 33 which cooperate with the pairs of contacts 5 and 6 of contact bridge 3,4. Preferably, these fixed contacts are formed by contact studs which are provided on particularly U-shaped terminal elements 36 and 38. A tap hole 40 in each web of the U elements is provided for a screw connection of an electrical conductor. Terminal elements 36 and 38 are clamped in corresponding recesses of the switch housing. They are prevented from slipping out of the internal parts of the switch, inter alia by a cover 41.

Upon shifting operating plunger 26 in the direction 42, the forked driver 25 of the plunger tilts the C shaped bracket spring 22 in the direction 42, so that the plane of the spring moves to approach a vertical position or neutral plane and the spring is compressed. As soon as the plane of the spring comes into the vertical position, the spring passes its labile or unstable position. At a slightest further motion in the direction 42, the slide 1 with the parts connected thereto jumps into the switched position. This causes the parts of movable contacts 5,6 to impinge on their associated fixed contacts 32, 33. A certain after-travel is made possible by helical compression springs 11 and 12.

With a standard spring wire strength, such a switch is bistable. It may be made monostable if an actuator is provided which is preferably tiltable and coupled to the outer end of operating plunger 26 and displaceable against the action of a return spring of sufficient strength. A certain, only not sufficiently strong, return force is also produced by helical tension spring 14.

With a particular embodiment of the invention, upon actuating the switch, and before the snap, the lateral portions of the bracket spring 22 impinge against a stop formed by the wall 45 of the switch housing, which shortens the traveling distance in this switching direction. Otherwise, the switch has a very large contact clearance which makes it suitable particularly for DC circuits. The cover 41 of the housing, preferably supporting the sealing sleeve 29 and the operating plunger 26, projects over the upper rim of housing 9 and is connectable thereto by locking or snap action.

In accordance with the invention, the switch is equipped with a resetting member 46 having one lever arm 47 located adjacent the inside end of operating plunger 26 and its other end 48 is located adjacent the corresponding end of slide 1. Resetting member 46 is pivotable about a pin 49 in the direction 50. The two lever arms having preferably unequal lengths, to obtain a mechanical advantage. More particularly, the lever arm associated with the operating plunger 26 is the longer one.

In the initial position of the switch, the two lever arms 47,48 or their ends apply against the respective plunger end and slide end or they are slightly spaced therefrom by distances corresponding to usual tolerances and which is somewhat exaggerated in the drawing. The downwardly directed arm 48 of resetting member 46 thus extends in the zone of displacement of slide 1, which, for switching, is shiftable in the direction 2. This means that while switching, thus while displacing operating plunger 26 in the direction 42 and therefore slide in the direction 2, the slide causes pivoting of resetting member 46 in the direction of arrow 51. Consequently, the upwardly directed arm 47 of resetting member 46 follows the motion of the associated inside end 52 of plunger 26. In the switched state of the switch, the positions shown in broken lines are reached by slide 1, operating plunger 26, and resetting 46. It is evident that in this position, the plunger end is farther away from arm 47 of the resetting member so that a dead clearance is formed which becomes effective during a resetting.

If for example, bracket spring 22 breaks and/or the like contacts stick to each other to an extent only that the bracket spring and the relatively weak helical tension spring 14 are unable to reset the slide, the contacts are separated from each other by displacing operating plunger 26 by a force exerted against the direction 42, particularly a manual force. As soon as the plunger end 52 hits the arm 47 of the resetting member (however, the dead clearance therebetween is not necessarily provided), the exerted force transformed by the other lever arm 48 casues a displacement of slide 1 in the direction 27, into the initial position thereof, and thus cause a disengagement of the sticking contacts from each other. Resetting member 46 thus also returns into its initial position (solid lines).

While a specific embodiment of the invention has been shown and described in detail to illustrate the application of the principles of the invention, it will be understood that the invention may be embodied otherwise without departing from such principles.

What is claimed is:

1. An electrical switch comprising a housing, first and second fixed contacts arranged in spaced relationship in said housing, a slide movably mounted on a movement path in said housing and having first and second spaced apart movable contacts thereon which are moved therewith into a contact making position in which they engage respective first and second fixed contacts, spring means urging said slide out of a contact making position, an actuating plunger movable on another movement path in said housing backwardly and forwardly substantially parallel to said slide, said slide and said plunger having adjacent ends in said housing with the end of said slide being spaced from said movable contacts, a snap spring engaged between said plunger in said slide being effective to snap said slide rapidly into and out of a contact making position when said plunger is moved in said housing in a predetermined direction, and a two armed resetting lever pivotally mounted in and to said housing at a fixed location between said plunger and said slide alongside the adjacent ends thereof and between said movement paths, said resetting lever having respective first and second arm portions extending in a straight line on opposite sides of said fixed location and positioned so that they engage the ends of the respective plunger and slide so that when said plunger is moved in a predetermined direction said slide is snapped in a corresponding opposite direction by said resetting lever which is pivoted in snap fashion by engagement with said plunger to cause said resetting member to slap and rapidly move said slide.

2. An electrical switch according to claim 1, wherein said first arm portion of said resetting lever extends directly alongside the end of said plunger and said second arm portion extends directly alongside the end of said slide member, said first and second arm portions of said resetting lever being of unequal lengths and including a longer arm portion disposed adjacent said plunger member and a shorter arm portion shorter than said longer arm portion disposed alongside said slide, said longer arm portion being narrower in a direction of movement of said plunger than said shorter arm portion.

3. An electrical switch according to claim 2, wherein said snap spring is mounted for pivoting on both said slide and said plunger, and is movable into a neutral plane which is transverse to the direction of movement of said slide and plunger, said snap spring having two end positions in which said snap spring is inclined relative to said neutral plane and into which position said snap spring is movable by shifting said plunger, said snap spring being pivotally mounted to said slide at a location spaced from said movable contacts.

* * * * *